US010214996B2

(12) United States Patent
Webber et al.

(10) Patent No.: US 10,214,996 B2
(45) Date of Patent: Feb. 26, 2019

(54) METHOD AND APPARATUS TO UTILIZE A METAL TO METAL SEAL

(71) Applicant: Baker Hughes Incorporated, Houston, TX (US)

(72) Inventors: Andrew Webber, Hockley, TX (US); Drayton W. Bryant, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 190 days.

(21) Appl. No.: 15/192,206

(22) Filed: Jun. 24, 2016

(65) Prior Publication Data

US 2017/0370187 A1 Dec. 28, 2017

(51) Int. Cl.
*E21B 34/08* (2006.01)
*E21B 34/14* (2006.01)

(52) U.S. Cl.
CPC ..... *E21B 34/14* (2013.01)

(58) Field of Classification Search
CPC .. E21B 21/103; E21B 34/14; E21B 2034/007; E21B 34/12; E21B 21/10; E21B 34/08
See application file for complete search history.

(56) References Cited

U.S. PATENT DOCUMENTS 4,574,894 A * 3/1986 Jadwin ..... E21B 21/103 137/118.03
4,602,684 A * 7/1986 Van Wormer ..... E21B 33/14 137/70
5,048,611 A * 9/1991 Cochran ..... E21B 21/103 166/319
6,082,458 A * 7/2000 Schnatzmeyer ..... E21B 34/06 166/317
6,230,811 B1 * 5/2001 Ringgenberg ..... E21B 21/103 166/320
8,272,443 B2 * 9/2012 Watson ..... E21B 34/103 166/305.1
8,899,334 B2 * 12/2014 Merron ..... E21B 34/14 166/323
8,978,773 B2 * 3/2015 Tilley ..... E21B 34/14 166/194
9,360,123 B2 * 6/2016 Webber ..... F16K 3/26
9,856,715 B2 * 1/2018 Themig ..... E21B 33/146
2006/0260820 A1 11/2006 Whitsitt et al.
2007/0272415 A1 * 11/2007 Ratliff ..... E21B 33/035 166/368

(Continued)

OTHER PUBLICATIONS

PCT International Search Report and Written Opinion; International Application No. PCT/US2017/033992; International Filing Date: May 23, 2017; dated Aug. 18, 2017; pp. 1-12.

*Primary Examiner* — Kipp C Wallace
(74) *Attorney, Agent, or Firm* — Cantor Colburn LLP

(57) ABSTRACT

In one aspect, a downhole device for use in a wellbore to selectively isolate a first pressure and a second pressure is disclosed, including a first piston including: a first sealing face to selectively isolate the first pressure and the second pressure; a first pressure face to receive the first pressure; and a second pressure face to receive the second pressure; and a second piston selectively coupled to the first piston, the second piston including a third pressure face to receive the second pressure; and a fourth pressure face to receive the first pressure, wherein the fourth pressure face is larger than the first pressure face.

20 Claims, 5 Drawing Sheets

(56) References Cited

U.S. PATENT DOCUMENTS

| | | | | |
|---|---|---|---|---|
| 2009/0056952 | A1* | 3/2009 | Churchill | E21B 21/10 166/373 |
| 2015/0330189 | A1 | 11/2015 | Themig et al. | |
| 2015/0337624 | A1* | 11/2015 | Themig | E21B 33/146 166/285 |

* cited by examiner

METHOD AND APPARATUS TO UTILIZE A METAL TO METAL SEAL

BACKGROUND

Field of the Disclosure

This disclosure relates generally to metal to metal seals and devices that utilize the same for downhole applications.

Background of the Art

Wellbores are drilled in subsurface formations for the production of hydrocarbons (oil and gas). In many operations it is required to selectively isolate fluid pressure from the annulus from fluid pressure within tubing as desired. Sealing devices are often utilized to isolate fluid pressures for both when annular pressure is greater than tubular pressure and when tubular pressure is greater than annular pressure. Certain sealing devices can be exposed to varying pressure differentials, requiring the use of multiple seals. Such sealing devices may not provide sufficient durability or robustness when exposed to varying pressure differentials. It is desired to provide a metal to metal seal that can allow for sufficient sealing while providing sufficient durability.

The disclosure herein provides metal to metal seals and downhole devices that utilize the same for downhole applications.

SUMMARY

In one aspect, a downhole device for use in a wellbore to selectively isolate a first pressure and a second pressure is disclosed, including a first piston including: a first sealing face to selectively isolate the first pressure and the second pressure; a first pressure face to receive the first pressure; and a second pressure face to receive the second pressure; and a second piston selectively coupled to the first piston, the second piston including: a third pressure face to receive the second pressure; and a fourth pressure face to receive the first pressure, wherein the fourth pressure face is larger than the first pressure face.

In another aspect, a method to selectively isolate a first pressure and a second pressure in a wellbore is disclosed, including receiving the first pressure via a first pressure face of a first piston; receiving the second pressure via a second pressure face of the first piston; receiving the second pressure via a third pressure face of a second piston; receiving the first pressure via a fourth pressure face of the second piston, wherein the fourth pressure face is larger than the first pressure face; selectively coupling the first piston and the second piston; and selectively isolating the first pressure and the second pressure via a first sealing face of the first piston.

In another aspect a downhole system for use in a wellbore is disclosed, including a casing disposed in the wellbore; a tubular disposed in the casing to define an annulus, the tubular having a tubular pressure and the annulus having an annular pressure; and a downhole device, including: a seal body; a first piston associated with the seal body, the first piston including: a first sealing face to selectively isolate the tubular pressure and the annular pressure; a first pressure face to receive the tubular pressure; and a second pressure face to receive the annular pressure; and a second piston selectively coupled to the first piston, the second piston including: a third pressure face to receive the annular pressure; and a fourth pressure face to receive the tubular pressure, wherein the fourth pressure face is larger than the first pressure face.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
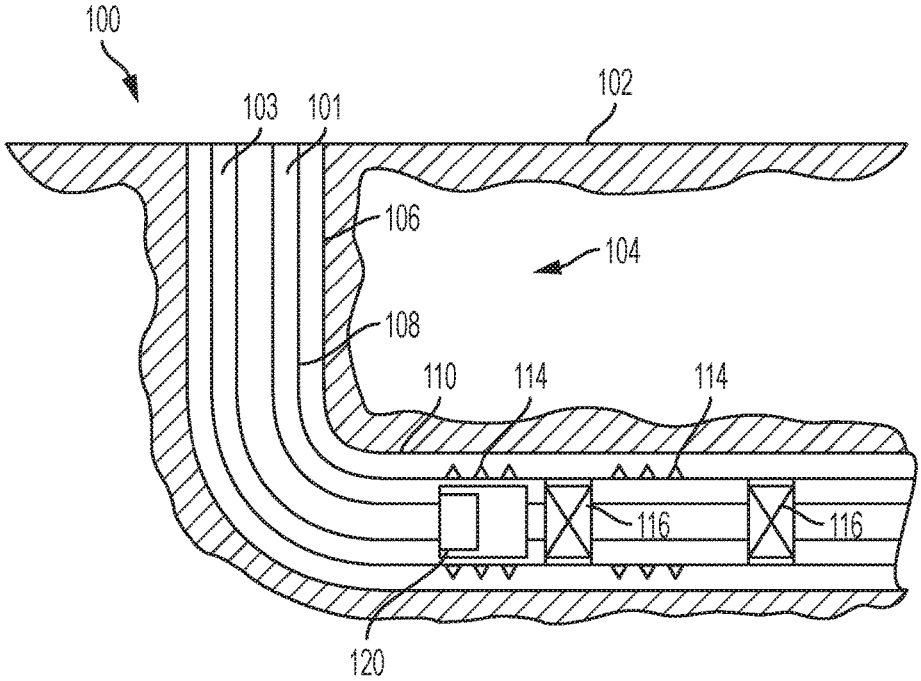
FIG. 1 is a schematic cross sectional diagram of an exemplary downhole system that includes a sealing device according to embodiments of the disclosure.

FIG. 1 shows an exemplary embodiment of a downhole system to facilitate the production of oil and gas. In certain embodiments, system 100 allows for operations to facilitate production of oil and gas. System 100 includes a wellbore 106 formed in formation 104 with casing 108 disposed therein.

In an exemplary embodiment, a wellbore 106 is drilled from a surface 102 to a downhole location 110. Casing 108 may be disposed within wellbore 106 to facilitate production. Wellbore 106 may be a vertical wellbore, a horizontal wellbore, a deviated wellbore or any other suitable type of wellbore or any combination thereof. In the illustrated embodiment, a tubular 101 can be disposed within the wellbore 106 to form an annulus 103. In the illustrated embodiment, the tubular 101 can carry a tubular flow within and the annulus 103 can carry an annular flow outside the tubular 101 within the casing 108. The tubular flow and the annular flow can each have pressures that can be isolated or equalized as desired.

To facilitate downhole operations, such as fracturing operations, other isolation operations etc., packers 116, sealing device 120 or other suitable downhole components are utilized within casing string 108. In certain embodiments, other downhole components can include, but are not limited to casing, mandrels, and housings for downhole tools, etc. In certain embodiments, annular fluid flow may be received from the formation 104 via perforations 114 in the casing 108. In the illustrated embodiment, a sealing device 120 can be used to selectively isolate flow within the tubular 101 from the annulus 103.

Figure 2:
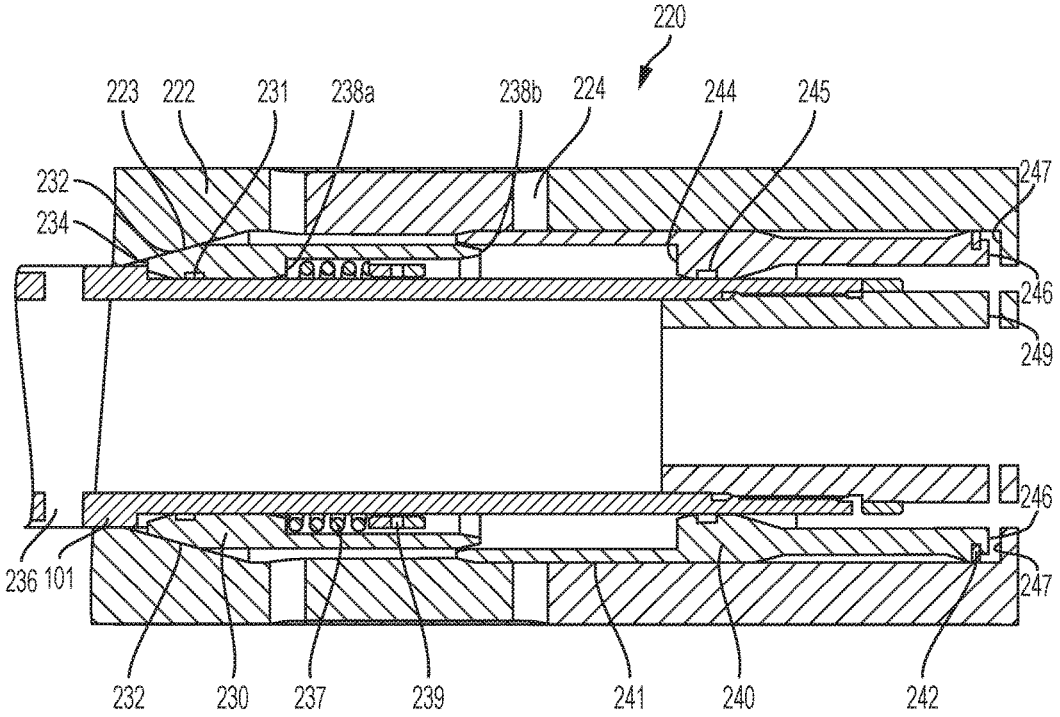
FIG. 2 is a schematic diagram of the sealing device according to one embodiment of the disclosure, wherein annular pressure is greater than tubular pressure.

Referring to FIG. 2, a sealing device 220 is shown. In the illustrated embodiment, the sealing device 220 includes a seal body 222, a sealing piston 230, and an energizing piston 240. In the illustrated embodiment, the sealing device 220 can selectively isolate tubular flow and pressure from the tubular 101 and annular flow and pressure from the annulus 103. In certain embodiments, the sealing device 220 can be disengaged to allow tubular pressure and annular pressure to be equalized. Advantageously, the sealing device 220 utilizes a self-energizing metal to metal seal to allow for a durable sealing surface while allowing for sufficient isolation between the tubular pressure and the annular pressure.

In the illustrated embodiment, the seal body 222 contains the sealing piston 230 and the energizing piston 240. The seal body 222 can be affixed to the tubular 101. In certain embodiments, the seal body 222 can be integrated with other downhole components. In the illustrated embodiment, the seal body 222 is exposed to the annulus 103. In the illustrated embodiment, the annular pressure port 224 can allow annular pressure from the annulus 103 to communicate with the sealing piston 230 and the energizing piston 240. In certain embodiments, the seal body 222 can include multiple annular pressure ports 224 to allow for annular flow therethrough.

In the illustrated embodiment, the sealing piston 230 is disposed within the seal body 222 and is further disposed around the tubular 101. In the illustrated embodiment, the sealing piston 230 can slide or otherwise translate along the tubular 101. The sealing piston 230 includes a first sealing face 232, a tubular pressure face 234, annular pressure faces 238*a,* 238*b,* and a preload device 237. In the illustrated embodiment, the sealing piston 230 urges or otherwise energizes the first sealing face 232 into a seal interface 223 of the seal body 222 to isolate the annular pressure from the tubular pressure. Advantageously, the first sealing face 232 allows for a metal to metal seal to allow for durability while allowing for a self-energizing seal as described herein.

In the illustrated embodiment, the first sealing face 232 engages the seal interface 223 of the seal body 222 to selectively isolate the tubular pressure from the annular pressure. The first sealing face 232 can be formed from a metal. Similarly, the seal interface 223 of the seal body 222 can be formed from metal to allow for a metal to metal seal. In the illustrated embodiment, the sealing piston 230 is energized by annular pressure, tubular pressure, and the preload device 237 to engage the first sealing face 232 into the seal interface 223. Advantageously, the first sealing face 232 can provide a durable seal while utilizing a single seal to isolate the annular pressure and the tubular pressure regardless of the pressure differential, such as when the annular pressure is greater than the tubular pressure and when the tubular pressure is greater than the annular pressure.

In the illustrated embodiment, the tubular pressure face 234 of the sealing piston 230 receives tubular pressure from the tubular 101 via a tubular flow port 236. The tubular pressure face 234 has a smaller piston area or face area than the tubular pressure face 246 of the energizing piston 240. As further described herein, the smaller face area of the tubular pressure face 234 allows for the first sealing face 232 to seal in varying pressure differentials as described herein.

In the illustrated embodiment, the sealing piston 230 can further include an inner pressure seal 231 to isolate the annular pressure from the tubular pressure. The inner pressure seal 231 can be formed of a conventional construction. In certain embodiments, the inner pressure seal 231 is an elastomeric seal. Advantageously, the inner pressure seal 231 is fully contained by the sealing piston 230 to allow for greater durability.

In the illustrated embodiment, the annular pressure faces 238*a,* 238*b* can receive annular pressure from the annulus 103. Annular fluid can flow from the annulus 103 to the annular pressure faces 238*a,* 238*b* via the annular flow port 224 of the seal body 222. In certain embodiments, the annular pressure can act upon multiple annular pressure faces 238*a,* 238*b,* while in other embodiments, the annular pressure may generally or in majority act upon a single annular pressure face 238*a*.

In the illustrated embodiment, a preload device 237 can provide an initial sealing or energization of the first sealing face 232. The preload device 237 can urge the first sealing face 232 to the seal interface 223 in the absence of sufficient annular pressure or tubular pressure. In the illustrated embodiment, the preload device 237 is a spring that urges the sealing piston 230 toward the seal interface 223. The spring can be of any suitable strength or force to provide adequate preload. In certain embodiments, the preload device 237 can utilize a spring mount 239 that acts against the tubular 101 to urge the sealing piston 230 towards the seal interface 223.

In the illustrated embodiment, the energizing piston 240 is selectively coupled to the sealing piston 230. The energizing piston includes a sleeve portion 241, an annular pressure face 244, an energizing seal 242, and a tubular pressure face 246. The energizing piston 240 can selectively couple with the sealing piston 230 to further energize the first seal face 232 by urging the sealing piston 230 towards the seal interface 223. In the illustrated embodiment, the energizing piston 240 can slide along the tubular 101 to engage with the sealing piston 230 or rest against the energizing piston stop 247 at the opposite end of travel.

In the illustrated embodiment, the sleeve portion 241 can be a cylindrical shape designed to at least partially overlap the sealing piston 230 along the tubular 101. Advantageously, the sleeved portion 241 of the energizing piston 240 can minimize the size of the energizing piston 240 and the overall size of the sealing device 220.

In the illustrated embodiment, an annular pressure face 244 of the energizing piston 240 can receive annular pressure from the annulus 103 via the annular pressure port 224. The annular pressure face 244 can receive annular pressure and apply a force to the energizing piston 240.

In the illustrated embodiment, the energizing piston 240 can further include an inner pressure seal 245 to isolate the annular pressure from the tubular pressure. The inner pressure seal 245 can be formed of a conventional construction. In certain embodiments, the inner pressure seal 245 is an elastomeric seal. Advantageously, the inner pressure seal 245 is fully contained by the energizing piston 240 to allow for greater durability.

In the illustrated embodiment, the energizing piston 240 can further include an energizing pressure seal 242 to isolate the annular pressure from the tubular pressure. The energizing pressure seal 242 can be formed of a conventional construction. In certain embodiments, the energizing pressure seal 242 is an elastomeric seal. Advantageously, the energizing pressure seal 242 is fully contained by the energizing piston 240 to allow for greater durability.

In the illustrated embodiment, the tubular pressure face 246 of the energizing piston 240 receives tubular pressure from the tubular 101 via a tubular flow port 249. The tubular pressure face 246 has a larger piston area or face area than the tubular pressure face 236 of the sealing piston 230. Therefore, as described herein, when the tubular pressure face 236 and the tubular pressure face 246 are exposed to the tubular pressure from the tubular 101, the tubular pressure face 246 will provide a greater force to the energizing piston 240 than the opposite force from the tubular pressure face 236, therefore urging the energizing piston 240 into the sealing piston 230 and urging the first sealing face 232 into the sealing interface 223.

In the illustrated embodiment, the energizing piston 240 can be limited in travel by the energizing piston stop 247. The tubular pressure face 246 can rest or be stopped by the energizing piston stop 247 when the energizing piston 240 is spaced apart from the sealing piston 230.

Figure 3:
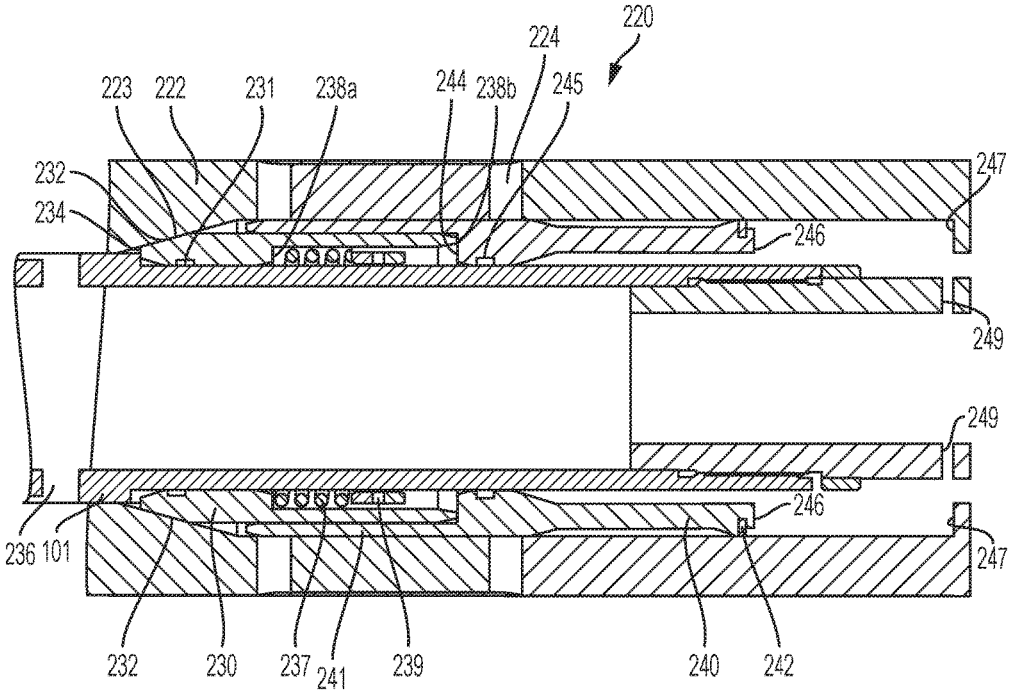
FIG. 3 is a schematic diagram of the sealing device of FIG. 2, wherein tubular pressure is greater than annular pressure.

Referring to FIGS. 2 and 3, operation of the sealing device 220 is shown. Referring to FIG. 2, in the illustrated embodiment, the annular pressure of the annulus 103 is greater than the tubular pressure of the tubular 101. In order to maintain isolation between the tubular pressure and the annular pressure, the first sealing face 232 is energized by the sealing piston 230. In FIG. 2, the annular pressure faces 238*a*, 238*b* receive annular pressure. The annular pressure acts upon the annular pressure faces 238*a*, 238*b* to create a force that urges the sealing piston 230 and therefore the first sealing face 232 toward the sealing interface 223 to energize the first sealing face 232. In the illustrated embodiment, the annular pressure forces can overcome forces provided by the tubular pressure.

Further, the annular pressure acts upon the annular pressure face 244 of the energizing piston 240. In FIG. 2, the annular pressure face 244 receives an annular pressure to provide a force to the energizing piston 240 to space the energizing piston 240 away from the sealing piston 230. The energizing piston 240 travel can be stopped by the energizing piston stop 247. In the illustrated embodiment, the annular pressure forces can overcome forces provided by the tubular pressure.

Referring to FIG. 3, operation of the sealing device 220 is shown when tubular pressure of the tubular 101 is greater than annular pressure of the annulus 103. In order to maintain isolation between the tubular pressure and the annular pressure, the first sealing face 232 is energized by the sealing piston 230. In FIG. 3, the annular pressure faces 238*a*, 238*b* receive annular pressure. The annular pressure acts upon the annular pressure faces 238*a*,238*b* to create a force that urges the sealing piston 230 and therefore the first sealing face 232 toward the sealing interface 223 to energize the first sealing face 232. However, since tubular pressure is greater than annular pressure, the tubular pressure can attempt to push the tubular pressure face 234 and the sealing piston 230 away from the sealing interface 223.

Advantageously, both tubular pressure faces 234 and 246 are exposed to tubular pressure. In the illustrated embodiment, the tubular pressure face 234 of the sealing piston 230 is smaller than the tubular pressure face 246 of the energizing piston 240. As a result, when exposed to the same tubular pressure, the tubular pressure face 234 of the sealing piston 230 produces a first force that may urge the sealing piston 230 away from the sealing interface 223. However, the tubular pressure face 246 of the energizing piston 240 receives the same tubular pressure, and creates a greater second force that translates the energizing piston 240 into the sealing piston 230. In the illustrated embodiment, the annular pressure faces 238*a* and 244 can be engaged or otherwise in contact. As a result, the energizing piston 240 urges the sealing piston 230 and the first sealing face 232 into the sealing interface 223 to maintain a seal even when the tubular pressure is greater than the annular pressure.

Figure 4:
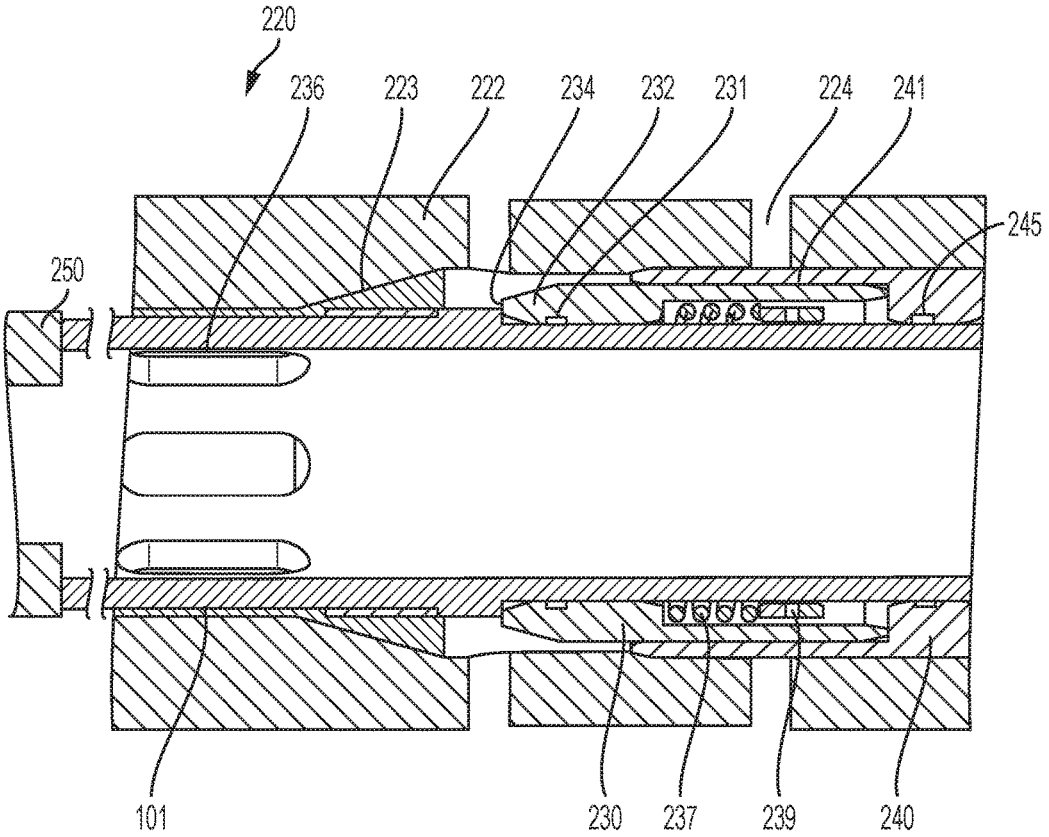
FIG.4 is a schematic diagram of the sealing device of FIG. 2, wherein the sealing device is partially retracted by a tool.

Referring to FIG. 4, the sealing device 220 can be retracted by a tool 250 to allow tubular pressure from the tubular 101 and annular pressure from the annulus 103 to be equalized. In the illustrated embodiment, a tool 250 can engage and act upon the tubular 101 to push the tubular 101. The tool 250 can push against the preload device 237 and the tubular and annular pressure to disengage the first sealing face 232 from the seal interface 223 to equalize the tubular and annular pressure as desired. In the illustrated embodiment, the tool 250 can translate the sealing piston 230 and the energizing piston 240 away from the sealing interface 223. Advantageously, as shown in FIG. 4, the sealing device 220 can be initially partially disengaged to prevent damage to the first sealing face 232 to allow for long term viability.

Figure 5:
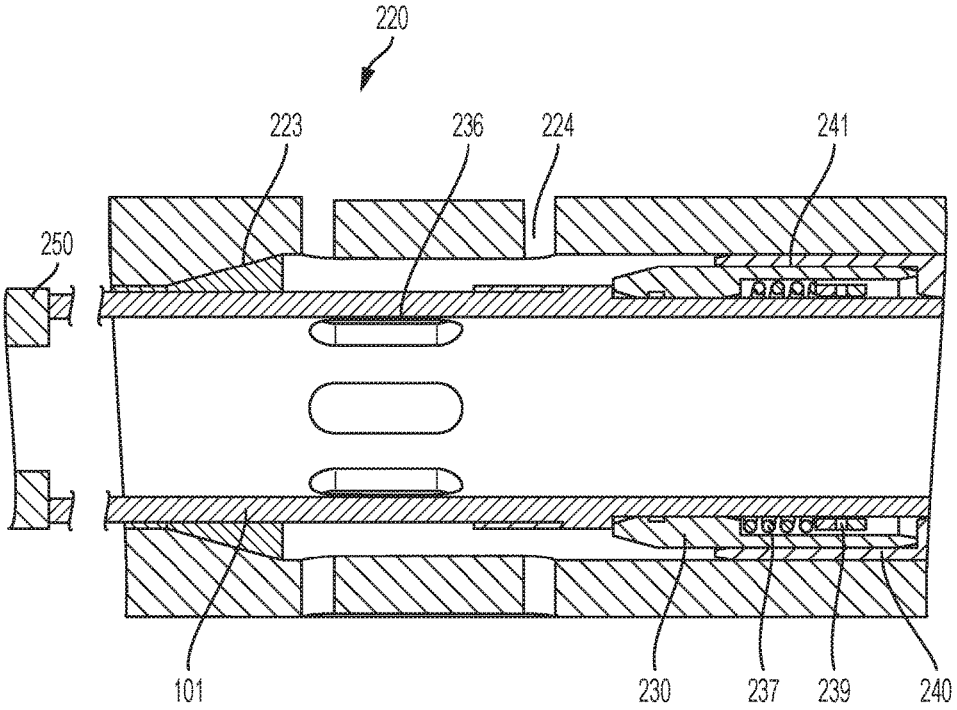
FIG. 5 is a schematic diagram of the sealing device of FIG. 2, wherein the sealing device is fully retracted by the tool.

Referring to FIG. 5, the tool 250 is shown fully retracting the sealing device 220. In the illustrated embodiment, the sealing piston 230 and the energizing piston 240 are fully translated away from the seal interface 223. The sealing device 220 can be fully opened to allow for equalized pressure between the tubular 101 and the annulus 103.

In one aspect, a downhole device for use in a wellbore to selectively isolate a first pressure and a second pressure is disclosed, including a first piston including: a first sealing face to selectively isolate the first pressure and the second pressure; a first pressure face to receive the first pressure; and a second pressure face to receive the second pressure; and a second piston selectively coupled to the first piston, the second piston including: a third pressure face to receive the second pressure; and a fourth pressure face to receive the first pressure, wherein the fourth pressure face is larger than the first pressure face. In certain embodiments, the first piston and the second piston are spaced apart in response to the second pressure being greater than the first pressure. In certain embodiments, first piston and the second piston are coupled in response to the first pressure being greater than the second pressure. In certain embodiments, the third pressure face of the second piston engages the second pressure face of the first piston in response to the first pressure being greater than the second pressure. In certain embodiments, the downhole device includes a preload device to engage the first sealing face. In certain embodiments, the preload device is a spring coupled to the first piston. In certain embodiments, the first sealing face is metal. In certain embodiments, the second piston is a sleeved piston and is at least partially disposed around the first piston. In certain embodiments, a tool translates the first piston and the second piston.

In another aspect, a method to selectively isolate a first pressure and a second pressure in a wellbore is disclosed, including receiving the first pressure via a first pressure face of a first piston; receiving the second pressure via a second pressure face of the first piston; receiving the second pressure via a third pressure face of a second piston; receiving the first pressure via a fourth pressure face of the second piston, wherein the fourth pressure face is larger than the first pressure face; selectively coupling the first piston and the second piston; and selectively isolating the first pressure and the second pressure via a first sealing face of the first piston. In certain embodiments, the method includes spacing apart the first piston and second piston in response to the second pressure being greater than the first pressure. In certain embodiments, the method includes coupling the first piston and the second piston in response to the first pressure being greater than the second pressure. In certain embodiments, the method includes engaging the third pressure face of the second piston to the second pressure face of the first piston in response to the first pressure being greater than the second pressure. In certain embodiments, the first sealing face is metal.

In another aspect a downhole system for use in a wellbore is disclosed, including a casing disposed in the wellbore; a tubular disposed in the casing to define an annulus, the tubular having a tubular pressure and the annulus having an annular pressure; and a downhole device, including: a seal body; a first piston associated with the seal body, the first piston including: a first sealing face to selectively isolate the tubular pressure and the annular pressure; a first pressure face to receive the tubular pressure; and a second pressure face to receive the annular pressure; and a second piston selectively coupled to the first piston, the second piston including: a third pressure face to receive the annular pressure; and a fourth pressure face to receive the tubular pressure, wherein the fourth pressure face is larger than the first pressure face. In certain embodiments, the first sealing face is engaged to the seal body to isolate the annular pressure from the tubular in response to the annular pressure being greater than the tubular pressure. In certain embodiments, the first piston and the second piston are coupled and the first sealing face is engaged to the seal body in response to the tubular pressure being greater than the annular pressure. In certain embodiments, third pressure face of the second piston engages the second pressure face of the first piston in response to the tubular pressure being greater than the annular pressure. In certain embodiments, the downhole device is disposed around the tubular. In certain embodiments, the first sealing face is metal.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A downhole device for use in a wellbore to selectively isolate a first pressure and a second pressure, the downhole device comprising:

a first piston including:

a first sealing face to selectively isolate the first pressure and the second pressure;

a first pressure face to receive the first pressure; and a second pressure face to receive the second pressure; and a second piston selectively coupled to the first piston, the second piston including:

a third pressure face to receive the second pressure; and a fourth pressure face to receive the first pressure, wherein the fourth pressure face is larger than the first pressure face so that, in response to the exposure of the fourth pressure face and the first pressure face to the first pressure, the second piston is urged into the first piston to urge the first sealing face into a position for isolating the first pressure from the second pressure.

2. The downhole device of claim 1, wherein the first piston and the second piston are spaced apart in response to the second pressure being greater than the first pressure.

3. The downhole device of claim 1, wherein first piston and the second piston are coupled in response to the first pressure being greater than the second pressure.

4. The downhole device of claim 3, wherein third pressure face of the second piston engages the second pressure face of the first piston in response to the first pressure being greater than the second pressure.

5. The downhole device of claim 1, further comprising a preload device to engage the first sealing face.

6. The downhole device of claim 5, wherein the preload device is a spring coupled to the first piston.

7. The downhole device of claim 1, wherein the first sealing face is metal.

8. The downhole device of claim 1, wherein the second piston is a sleeved piston and is at least partially disposed around the first piston.

9. The downhole device of claim 1, wherein a tool translates the first piston and the second piston.

10. A method to selectively isolate a first pressure and a second pressure in a wellbore, the method comprising:

receiving the first pressure via a first pressure face of a first piston;

receiving the second pressure via a second pressure face of the first piston;

receiving the second pressure via a third pressure face of a second piston;

receiving the first pressure via a fourth pressure face of the second piston, wherein the fourth pressure face is larger than the first pressure face;

selectively coupling the first piston and the second piston based on the first pressure being greater than the second pressure; and selectively isolating the first pressure and the second pressure via a first sealing face of the first piston based on a force on the fourth pressure face being greater than a force on the first pressure face, thereby urging the first sealing face into a position for isolating the first pressure from the second pressure.

11. The method of claim 10, further comprising:

spacing apart the first piston and second piston in response to the second pressure being greater than the first pressure.

12. The method of claim 10, further comprising coupling the first piston and the second piston in response to the first pressure being greater than the second pressure.

13. The method of claim 12, further comprising engaging the third pressure face of the second piston to the second pressure face of the first piston in response to the first pressure being greater than the second pressure.

14. The method of claim 10, wherein the first sealing face is metal.

15. A downhole system for use in a wellbore, comprising:

a casing disposed in the wellbore;

a tubular disposed in the casing to define an annulus, the tubular having a tubular pressure and the annulus having an annular pressure; and a downhole device, including:

a seal body;

a first piston associated with the seal body, the first piston including:

a first sealing face to selectively isolate the tubular pressure and the annular pressure;

a first pressure face to receive the tubular pressure; and a second pressure face to receive the annular pressure; and a second piston selectively coupled to the first piston, the second piston including:

a third pressure face to receive the annular pressure; and a fourth pressure face to receive the tubular pressure, wherein the fourth pressure face is larger than the first pressure face so that, in response to the exposure of the fourth pressure face and the first pressure face to the tubular pressure, the second piston is urged into the first piston to urge the first sealing face into a position for isolating the tubular pressure from the annular pressure.

16. The downhole system of claim 15, wherein the first sealing face is engaged to the seal body to isolate the annular pressure from the tubular in response to the annular pressure being greater than the tubular pressure.

17. The downhole system of claim 15, wherein the first piston and the second piston are coupled and the first sealing face is engaged to the seal body in response to the tubular pressure being greater than the annular pressure.

18. The downhole system of claim 17, wherein third pressure face of the second piston engages the second pressure face of the first piston in response to the tubular pressure being greater than the annular pressure.

19. The downhole system of claim 15, wherein the downhole device is disposed around the tubular.

20. The downhole system of claim 15, wherein the first sealing face is metal.

* * * * *